United States Patent [19]

Somerville et al.

[11] 3,945,608

[45] Mar. 23, 1976

[54] ANCHORING MEANS FOR EARTH TUNNELING DEVICES

[76] Inventors: John G. Somerville, 2740 Old Willow Road, P.O. 611, Northbrook, Ill. 60062; David J. Vasicek, 539 Glenwood SE., Grand Rapids, Mich. 49506

[22] Filed: Sept. 12, 1974

[21] Appl. No.: 505,483

[52] U.S. Cl. ..... 254/29 R

[51] Int. Cl.[2] ..... E21B 19/00

[58] Field of Search ..... 254/29 R–31; 175/22, 44; 61/72.7; 173/36

[56] References Cited

UNITED STATES PATENTS

| | | | |
|---|---|---|---|
| 1,962,466 | 6/1934 | Scott et al. | 254/29 R |
| 2,056,489 | 10/1936 | Scott et al. | 254/29 R |
| 2,612,343 | 9/1952 | Fraizer et al. | 254/29 R |
| 2,882,011 | 4/1959 | Ripstein | 254/29 R |
| 3,726,506 | 4/1973 | Vanderwaal | 254/29 R |

*Primary Examiner*—Othell M. Simpson

[57] ABSTRACT

An anchoring means for an earth works tunneling device includes a unit having two planar back-stop members secured together in spaced relation from one another. Between the back-stop members is provided a means for mounting the tunneling device so that a force exerted on the device is transmitted to the stop members. Thus, as the device drives or pulls a pipe or pipe stem through the earth, the counterreactive force is transmitted to one of the stop members which pushes against the adjacent earth bank so as to anchor the tunneling device.

10 Claims, 7 Drawing Figures

ANCHORING MEANS FOR EARTH TUNNELING DEVICES

BACKGROUND OF THE INVENTION

The present invention relates to earth working machinery and, more specifically, to an anchoring means for earth tunneling devices.

In laying pipelines, electric transmission lines, cable, etc, through road beds and other places where it is undesirable to dig a trench along the top of the earth, various tunneling devices have been developed.

These tunneling devices generally either drive a pipeline through the earth between trenches on each side of the earth section which is to be tunneled or a stem is first driven through the earth and then it is pulled back through the earth with the pipe attached thereto.

One common tunneling device which utilizes such a stem system is attached to a trenching machine known as a backhoe. Normally, this device is lowered into the ditch adjacent the earth section to be tunneled and by vertical up and down motion of the hydraulic lift system of the backhoe, the stem is forced through the earth to displace the stem sections into the earth under the road or other earth section which is to be tunneled.

The tunneling device, as it drives the stem into the earth, creates a counterreactive force which tends to force the device in a direction opposite to which the stems are driven. To prevent movement of the device in such opposite direction, several telescoping anchor arms, known as jacks, are attached to the device and extend from it to engage the earth bank so as to provide a back stop for the devices.

Upon each use, these jacks must be attached to the tunneling device, telescoped and locked into place against the earth bank. If the earth bank is not sufficiently solid enough to secure one or more of the jacks, the tunneling device will shift and become askew preventing further driving of the stem. After so shifting, the tunneling device must be realigned and the jacks reset which frequently requires pulling of the stem because of its askew position.

With such prior apparatus, after the stem is driven through the entire section of earth to be tunneled and before the stem is pulled back through the earth with the pipe, etc. attached thereto, the jacks must be repositioned on the opposite side of the tunneling device to provide a back stop for the device as it pulls on the pipe. The operation of these prior devices as above described obviously spells out many problems, including the inability to consistently drive the stems in a straight line. This causes breakage of equipment, misalignment of the pipe, and a very slow operation caused by the requirement to realign these tunneling devices and its associated jacks and also the complete removal and positioning of the jacks. Further, since frequently the ditch is filled with loose dirt, muck, or water, fouling of the tunneling device may result. Also, it is difficult with present equipment to feed the stems straight into the tunneling device.

Accordingly, there has been a long-felt need for improved means for anchoring tunneling devices as above described.

OBJECTS AND SUMMARY OF THE INVENTION

It is an object of the present invention to provide an anchoring means for an earth tunneling device which will solidly anchor the device in the earth no matter which direction of force is exerted by the device.

It is a further object to provide an anchoring means for an earth tunning device which does not require telescoping and locking of parts before each time the tunneling device is used.

It is still a further object to provide an anchoring means for an earth tunneling device which, when firmly engaging the earth, does not sink into or move around in the earth.

It is even a further object to provide an anchoring means for an earth tunneling device which keeps the device from clogging with dirt, muck, or water when placed in a ditch or hole adjacent the earth.

It is even still a further object to provide an anchoring means for an earth tunneling device which may include a flooring for keeping the area adjacent the device clear when feeding pipe or stem sections into the device.

These and other objects are accomplished in the present invention by an anchoring means for an earth tunneling device utilizing two planar back-stop members and two elongated spacing members attached between the abutting portions which rigidly secure them in spaced relation from each other.

The planar back-stop members include at least one port therein to allow stems, pipes, etc., from the tunneling device to extend through the members and into the earth.

The elongated spacing members include means thereon for mounting or locking the tunneling device in spaced relation between the back-stop members.

When the tunneling device is engaged, one of the back-stop members push against the adjacent earth so as to resist movement caused by the counterreactive force exerted on the tunneling device which is secured to the elongated spacing members.

In the preferred embodiment, the means for mounting the tunneling device on the anchor means includes circular bar members which extend along and are attached to the two spacing members.

Also, in the preferred embodiment of this invention, a flooring is placed between the back-stop members at the bottom of the anchoring means. When utilized, the flooring prevents clogging of the tunneling device by dirt, muck, or water in the ditch or hole in which the tunneling device is placed. Further, the flooring provides a suitable loading and unloading surface for feeding pipe or stem sections into the tunneling device and attaching other sections thereto.

DESCRIPTION OF THE PREFERRED EMBODIMENT

Figure 1:
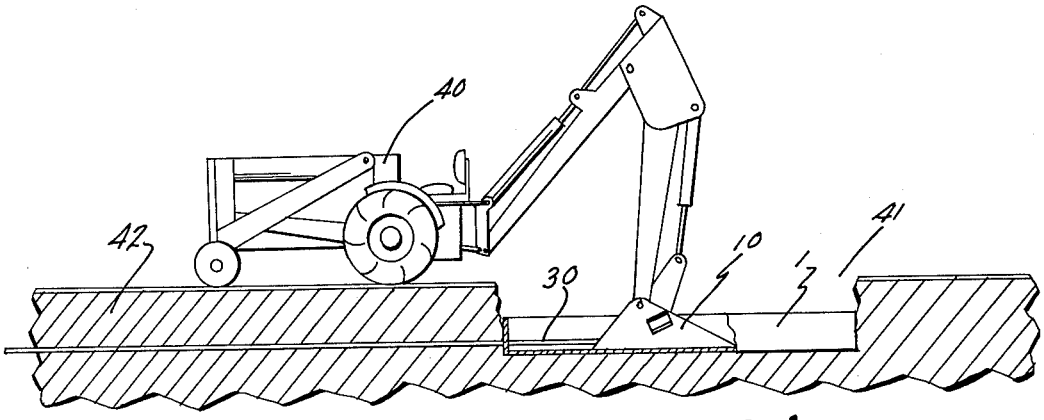
FIG. 1 is a schematic view with portions thereof cut away of a tunneling operation in which this invention is used.

Referring to FIG. 1, an anchor means 1 for tunneling device 10 which is attached to a conventional backhoe 40 is placed with device 10 mounted therein at the bottom of a hole 41 positioned adjacent road 42. Backhoe 40 powers tunneling device 10 which drives stems 30 into road 42 and anchor means 1 prevents sliding of and otherwise secures device 10 in hole 41.

Figure 5:
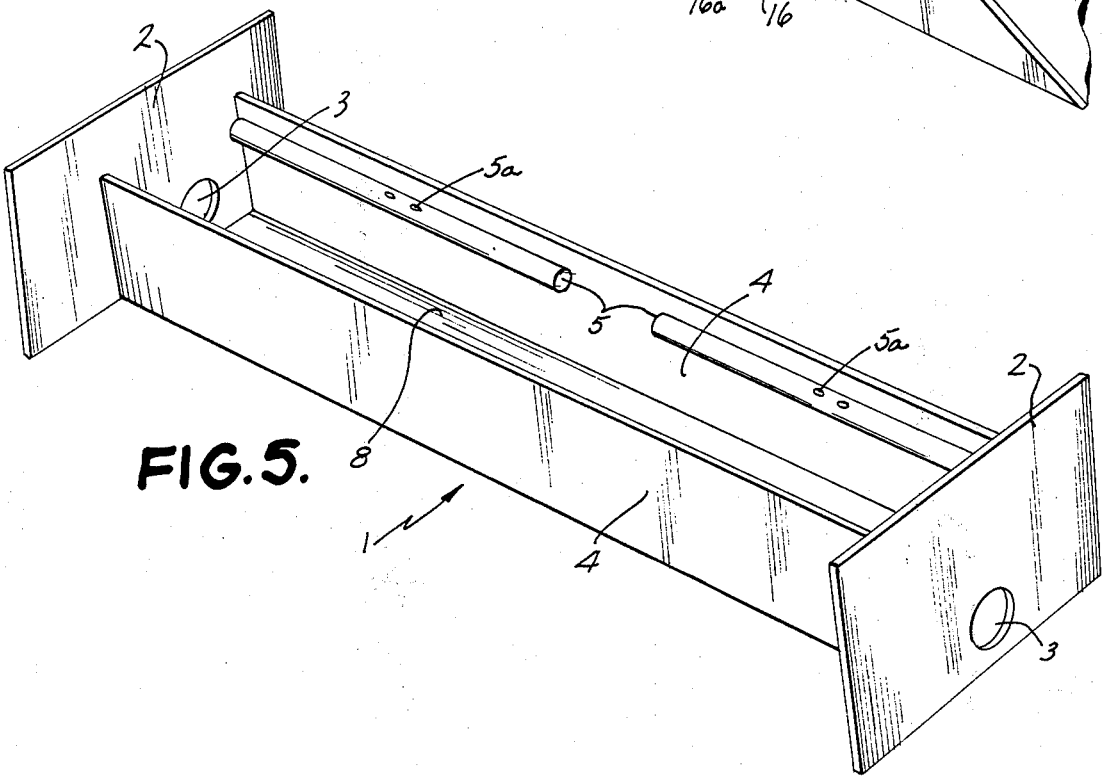
FIG. 5 is a top and side elevational perspective view of the anchor means for an earth works tunneling device.

Referring particularly to FIG. 5, the anchor means 1 for an earth works tunneling device 10 includes backstop members or end plates 2 and two elongated spacer members 4 which are attached between and secure back stop or end plates 2 in spaced relation from each other. An earth works tunneling device 10, is secured in anchor means 1 as shown in FIG. 2.

In the embodiment of the anchor means for an earth works tunneling device 10 shown in the figures, backstop members or end plates 2 are generally planar and rectangular in shape and comprise therein generally circular ports 3. The end plates 2 are secured in spaced relation from each other by spacer members 4 which are generally elongated and rectangular in shape and are rigidly attached to the end plate 2 so as to not obstruct access to port 3. As is apparent from these figures, spacer members 4 are generally parallel to each other and extend perpendicularly from end plates 2.

A rectangular flooring 8 is secured between end plates 2 and spacer members 4 so that anchor means 1 has a trough-like appearance. Flooring 8 may also act to secure end plates 2 in spaced relation from each other. Flooring 8, similar to spacer members 4, does not obstruct access to ports 3.

Figure 2:
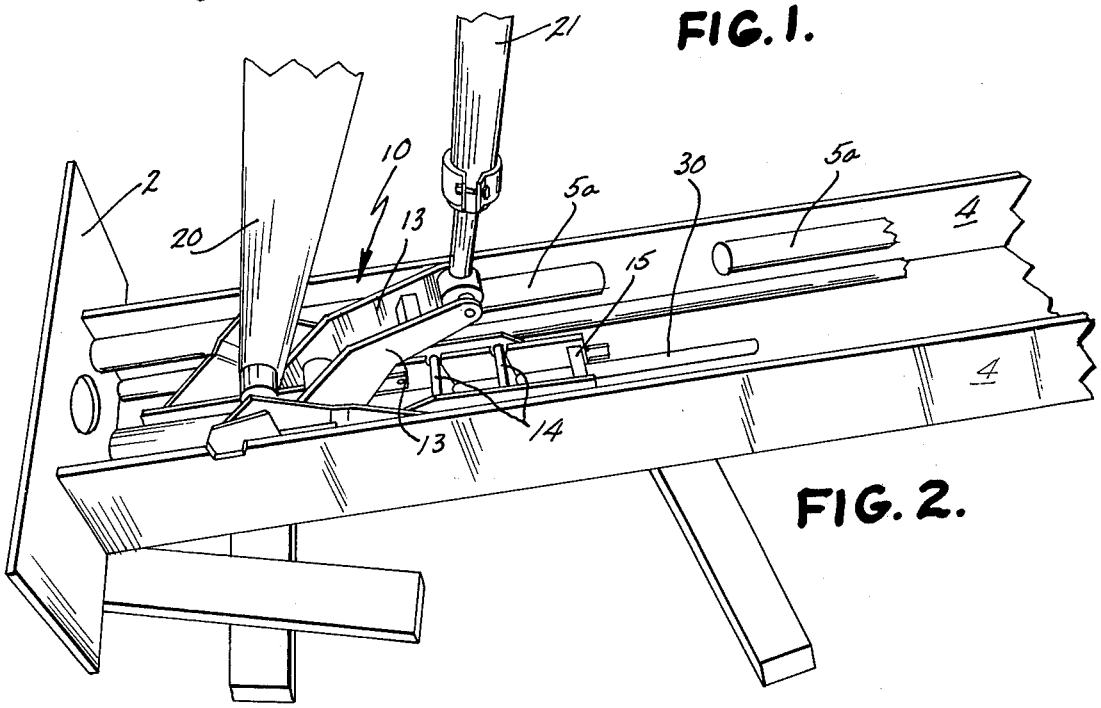
FIG. 2 is a partial top and side elevational perspective view of the anchor means for an earth tunneling device with the device secured therein.

As shown in FIG. 2 only, a further reinforcing member or bar 6 may be secured between end plates 2 to aid in securing end plates 2 in spaced relation.

Figure 6:
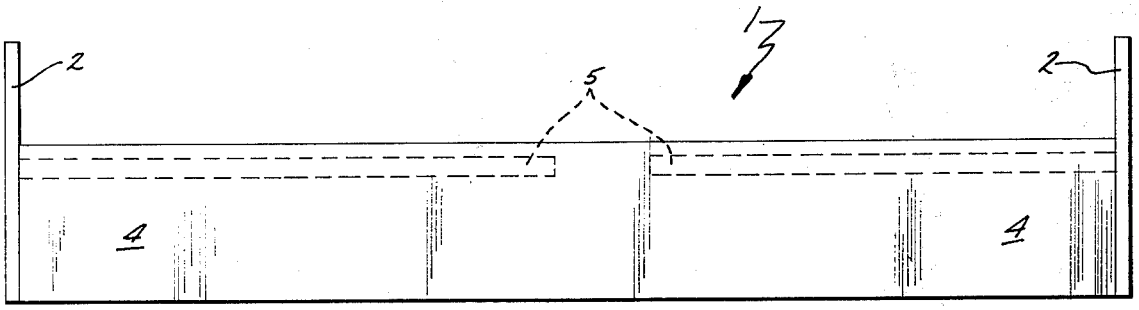
FIG. 6 is an elevational side view of the anchor means for an earth works tunneling device.
Figure 7:
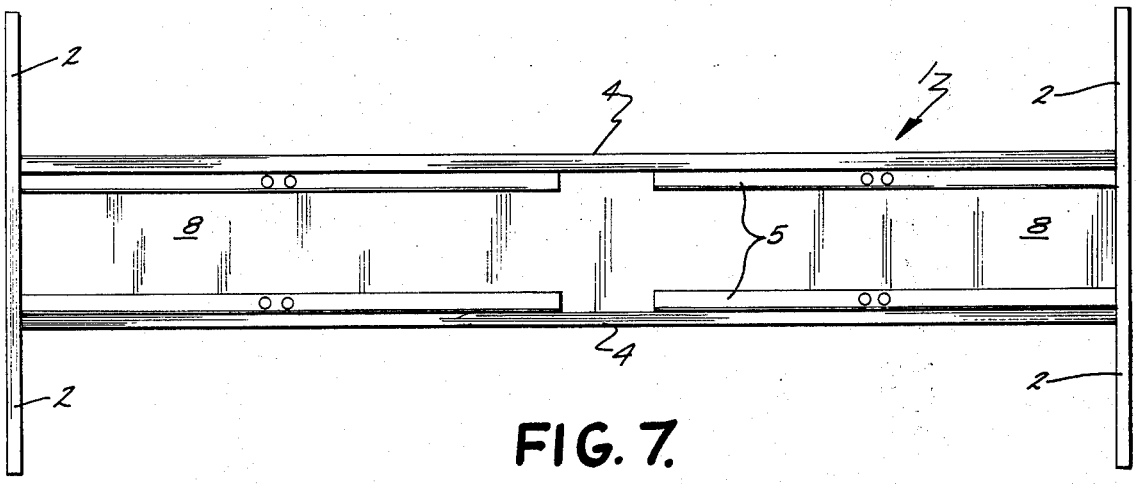
FIG. 7 is a plan view of the anchor means for an earth works tunneling device.

As best shown in FIGS. 5–7, means for securing a tunneling device in spaced relation between end plates 2 is provided by support bars 5 which are secured to spacer members 4 and are generally parallel to each other along the interior walls of spacer members 4. These support bars comprise therein bolt holes **5*a* for securing a tunneling device to support bars 5 in a fixed position. As best shown in FIG. 6, support bars 5 do not continuously extend between end plates 2 but comprise an open portion therein for allowing slidable mounting of a tunneling device onto the support bars 5**.

Figure 3:
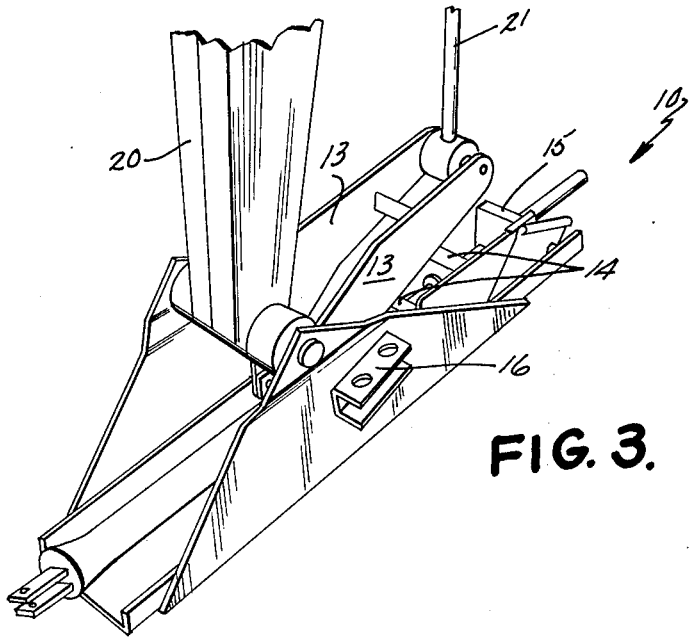
FIG. 3 is a top and side elevational perspective view of the earth tunneling device.
Figure 4:
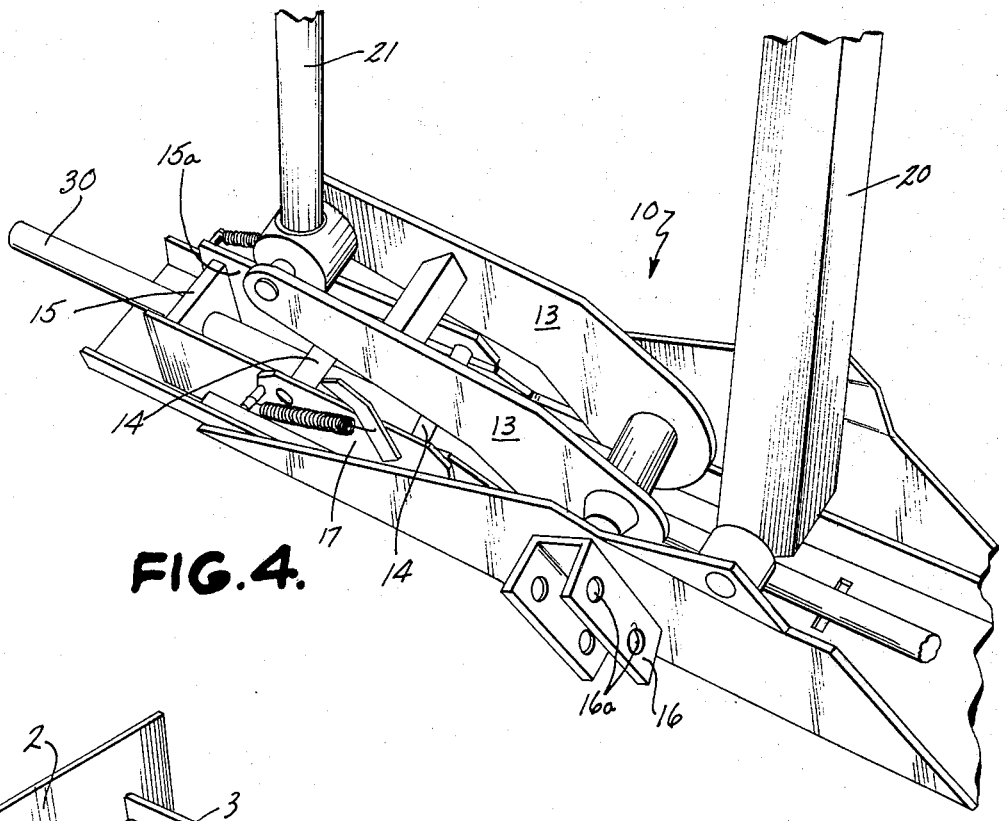
FIG. 4 is a top and side elevational perspective view of the earth tunneling device from the side opposite that shown in FIG. 3.

Referring to FIGS. 2, 3, and 4, tunneling device 10 consists of a generally U-shaped frame or housing 11 which contains therein slanted driving clamps 14 which are connected to driving arms 13. Clamps 14 include a circular opening therein allowing close engagement with the outer surface of pipe or stem 30 when it is inserted therethrough. Rigid guide 15 anchored to housing 11 acts to secure stem or pipe 30 when inserted through the slanted driving clamps 14.

Arms 13 are connected to clamps 14 and clamps 14 are rotatably mounted so that as arms 13 move up and down in a reciprocating motion, clamps 14 move in a corresponding manner. In particular, when a pipe or stem 30 is inserted through guide 15 and the circular openings in clamps 14 and arms 13 are moved, clamps 14 engage pipe or stem 30 by pressing down thereon, slide it in the direction that the clamps 14 are slanted, release pipe or stem 30 and reciprocate back and reengage it again at another position.

When it is desired to change the direction which driving clamps 14, displace pipe or stem 30, control 17 which is connected to clamps 14 as shown in FIG. 4, is pivoted so that the direction of the slant of the clamps 14 is changed and arm 13 moves clamps 14 and clamps 14 engage pipe or stem 30 and displace it in the above-described manner.

Tunneling device 10 is secured to support bars 5 of anchor means 1 by sliding mounts 16 of device 10 over the support bars 5. As seen in FIGS. 2 and 3, mounts 16 are pivotally attached to the outside of housing 11 of tunneling device 10 and are generally U-shaped and open outward from the tunneling device so that they may slide along support bars 5 without being obstructed by spaced members 4. Mounts 16 comprise therein bolt holes 16a which correspond to bolt holes 5a on support bars 5 for bolting device 10 onto the support bars 5.

Before mounting onto anchor means 1, tunneling device 10 is attached to a conventional trenching machine known as a "backhoe." Tunneling device 10 is attached to the backhoe (not shown) by means of movable support arm 20 shown in FIGS. 1–3 which extends downward from the backhoe and enables raising and lowering of tunneling device 10 into the vertical position desired. Tunneling device 10 is also attached to the backhoe hydraulic lift arm 21 which provides the up and down driving motion for driving arm 13.

The embodiment of tunneling device 10 herein discussed and shown in FIGS. 2, 3, and 4 is known as a POWER MOLE and is manufactured by POW-R DEVICES, INC. of Clarence Center, New York 14032.

This tunneling device is one among several conventional devices which may be suitable for use with the anchor means of the present invention.

OPERATION

When it is desired to drive a stem or pipe 30 through an earth works such as a roadway 42, anchor means 1 is placed in a ditch or hole 41 adjacent the roadway 42 and aligned in the direction in which it is desired to drive the stem (or pipe) 30 therethrough. Tunneling device 10, which is attached to a backhoe by support arm 20 and hydraulic arm 21, is lowered into anchor means 1 so that mounts 16 are generally aligned for slidable engagement with support bars 5. When so aligned, tunneling device 10 is horizontally displaced along support bars 5 until bolt holes **16*a* on mounts 16 are aligned with bolt holes 5*a* on the support bars 5. When so aligned, bolts are secured through the bolt holes and tunneling device 10 is locked in spaced relation between the end plates 2**.

A stem or pipe 30 is fed into tunneling device 10 along tracks 15 and through the downwardly open portion of clamps 14. Stem 30 extends through port 3 and into the earth works through which it is desired to tunnel.

After clamps 14 are shifted by control 17 to slant in the desired direction of tunneling, hydraulic lift arm 21 of backhoe is activated. While activated, lift arm 21 moves driving arms 13 up and down in a reciprocating motion, while arms 13 in turn drive clamps 14 which displace stem 30 into the earth works as here before discussed.

If stem 30 is formed in sections, as each section is driven into the earth works, another section is attached to its end using flooring 8 as an attaching platform.

As stems 30 are being driven into the earth works, tunneling device 10 is biased in a direction opposite to that in which wedges 14 are driving stem 30. The end plate 2 which is so directed acts to engage earth works adjacent the ditch or hole and prevents displacing of tunneling device 10.

Once stem 30 is driven through the earth works, if it is desired to push a larger stem or pipe through the earth works, an enlarger coupler 31, such as shown in FIG. 2, is attached to stem 30 and to the larger stem or pipe and driven into the earth works.

Once driven through the earth works, a pipeline, cable, etc., is attached to stem 30 and control 17 is rotated so as to change the direction of slant of clamps 14. Once so changed, hydraulic arm 21 is activated and the clamps 14 pull stem 30 back through the earth works with the pipeline, cable, etc. attached thereto.

When pulling stem 30 back through the earth works, tunneling device 10 is biased toward the earth works and the end platae 2 so directed engages the earth works and prevents displacement of tunneling device 10 attached thereto.

As seen in FIG. 2, if it is desired, boards 9 or other props may be used to generally level anchor means 1. However, in most cases where the ditch or hole adjacent the earth works being tunneled through is generally level, the rectangular shape of end plates 2 will generally align tunneling device 10 so that such leveling is not needed.

It will be understood that various changes in the details, materials, steps, and arrangements of parts which have been herein described and illustrated in order to explain the nature of the invention, may be made by those skilled in the art within the principle and the scope of the invention as expressed in the appended claims.

The embodiment of the invention in which an exclusive property or privilege is claimed are defined as follows:

1. An anchor means for an earth working tunneling device comprising:

two back stop members, at least one of said back stop members having a circular port formed therein, elongated spacer members attached between said back stop members and rigidly securing said members in spaced relation from each other, said spacer members and said back stop members dimensioned so that the tunneling device and one end of the associated pipe or rod driven by the tunneling device are positioned wholly within the comfines of said members; and means secured along the inner surfaces of said spacer members for slidably mounting a tunneling device in spaced relation between said back stop members.

2. The anchor means of claim 1 wherein said means for mounting a tunneling device between the back stop members includes bar members which extend along the inner surfaces of said spacing members and are attached to said spacing members, said bar members including means for adjustably attaching a tunneling device thereto.

3. The anchor means of claim 1 further including a flooring, said flooring extending between said back stop members and being attached thereto and extending along the bottom of the anchor means.

4. The anchor means of claim 3 wherein said flooring is also attached to said spacer members and extends therebetween.

5. The anchor means of claim 1 wherein said spacer members are bar members, said bar members including a means for mounting a tunneling device thereon.

6. In combination with an earth works tunneling device, said tunneling device being places adjacent an earth works and when tunneling through the earth works being biased, an anchor means for the tunneling device comprising:

two back stop members;

two elongated spacer members attached between said back stop members and rigidly securing said members in spaced relation from each other;

at least one access port in one of said back stop members allowing communication between the tunneling device and the earth works; and means secured along the inner surfaces of said spacer members for slidably mounting the tunneling device in spaced relation between said back stop members and for permitting multiple positioning of said tunneling device whereby said back stop members counter the bias of the tunneling device when tunneling through earth works.

7. The anchor means of claim 6 wherein said means for mounting a tunneling device in spaced relation between said back stop members includes bar members which extend along and are attached to the inner surfaces of said spacing members.

8. The anchor means of claim 6 further including a flooring, said flooring extending between said back stop members and being attached thereto and extending along the bottom of the seat.

9. The anchor means of claim 6, wherein said spacing members extend in a parallel spaced relationship between said back stop members and the ends of said back stop members extend outwardly from and perpendicular to said spacer members.

10. In a combination with an earth works tunneling device for driving stem portions through an earth works, said tunneling device including adjustable slanted clamps with a circular open portion therein, and up-and-down reciprocating driving arms, said clamps being attached to said arms and being driven by the up-and-down reciprocating motion thereof, and said clamps being capable of insertion of a stem portion through said circular open portion therein and after insertion of a stem portion therethrough, said clamps being capable of driving stem portions through the earth works in the direction the clamps are slanted by pressing down on the stem portion, sliding it in the direction that the wedges are slanted, releasing the stem portion and reciprocating back and reengaging the stem portion at another position thereon when said arms are moved in an up-and-down reciprocating motion, said reciprocating motion of said arms and said clamps biasing the tunneling device; an anchor means for the earth works tunneling device comprising:

two rectangular back stop members;

two elongated spacer members attached between said back stop members and rigidly securing said members in spaced relation from each other;

a flooring extending between the bottom edges of said rectangular back stop members, said flooring also extending between said elongated spacer members;

at least one access port in each of said back stop members allowing the stem portions being driven by the wedges of the tunneling device to extend through said back stop members and into the earth works; and mounting means including four bar members, two bar members extending perpendicularly from and being attached to each of said rectangular back stop members and each bar being further attached to one of said spacer members and being positioned between said spacer members, the bar members on each spacer member having a space therebetween allowing slidable mounting of the tunneling device thereon, said bar members further including means for attaching said tunneling device thereto and when so mounted thereto, the bias of the tunneling device created by the clamps and up-and-down reciprocating motion of the driving arms, being countered by engagement of said rectangular back stop members with adjacent earth works.

* * * * *